United States Patent [19]

Young

[11] 4,454,030

[45] Jun. 12, 1984

[54] SPRUE SEPARATOR

[75] Inventor: James L. Young, Pascoag, R.I.

[73] Assignee: Nelmor Company, Inc., North Uxbridge, Mass.

[21] Appl. No.: 277,900

[22] Filed: Jun. 26, 1981

[51] Int. Cl.[3] ..... B07B 13/04

[52] U.S. Cl. ..... 209/669; 209/616; 209/660

[58] Field of Search ..... 209/616, 669, 662, 660, 209/615, 621, 659, 667, 671, 672, 673, 674, 675, 689, 690; 425/217; 198/660, 661, 662, 676, 677

[56] References Cited

U.S. PATENT DOCUMENTS

| | | | |
|---|---|---|---|
| 1,022,655 | 4/1912 | Brine | 209/662 |
| 2,274,960 | 3/1942 | Herrin | 209/662 |
| 2,415,970 | 2/1947 | Snook et al. | 209/662 |
| 3,011,635 | 12/1961 | Jouin | 209/669 |
| 3,329,263 | 7/1967 | Rush et al. | 209/662 |
| 3,373,868 | 3/1968 | Missioux et al. | 209/551 X |
| 3,884,800 | 5/1975 | Helmolt, Sr. | 209/675 |

FOREIGN PATENT DOCUMENTS

| | | | |
|---|---|---|---|
| 0039560 | 11/1931 | France | 209/672 |

*Primary Examiner*—Robert B. Reeves
*Assistant Examiner*—Edward M. Wacyra
*Attorney, Agent, or Firm*—Maurice R. Boiteau

[57] ABSTRACT

There is disclosed in the present application an apparatus for sorting acceptable molded parts from material coming from a molding machine and requiring to be reprocessed or recycled. The present apparatus includes an auger formed with closely spaced flights in a receiving zone and more widely spaced flights in a transport zone in which scrap such as sprues, runners and defective molded parts are carried to a scrap discharge area. The acceptable articles, which have already been separated from the sprues and runners upon discharge from the mold, are of a size which allows them to pass between the closer flights of the receiving zone whereas the sprue and runner assemblies are carried by both the closer and more widely spaced flights to the scrap discharge area.

4 Claims, 6 Drawing Figures

SPRUE SEPARATOR

The present invention relates generally to improvements in apparatus for sorting parts and scrap materials according to size and more particularly to apparatus especially adapted to being positioned near a molding machine for sorting acceptable parts from portions of the output of the molding machine which are not usable and need to be recycled.

A common problem at molding machines is the need for sorting the output of the machine into those acceptable molded parts which are usable and will hereinafter be referred to as product, from the sprues, runners and scrap which require recycling, usually by being granulated and mixed with virgin resins for the economical production of more product. In the course of this specification, the material to be recycled will be referred to collectively as scrap. Usually, the product emerges from the molding machine, which cycles automatically, separated by the opening of the mold from the sprues and runners and ready to be sorted between product to be further processed or shipped and scrap to be recycled. However, since the machine operator may be tending several molding machines, it is not economically feasible in a typical production situation for the operator to sort the product and scrap manually.

Sorting devices have been provided to eliminate the need for operator involvement in the sorting process, but such prior device have not been entirely satisfactory for the purpose. In some cases, the movement of product and scrap toward their destinations is obtained by interrupted or reciprocating motions which are inherently noisy, the cause of objectionable vibration and result in a shortened machine life. Other types of machines have not been satisfactory because of their tendency to include considerable scrap with the product in performing the sorting operation.

It is accordingly an object of the present invention to provide a relatively inexpensive and durable machine for performing sorting operations.

Another object is a machine whose operation is generally free of noise and vibration.

A more particular object is to accomplish the sorting with accuracy while operating on product and scrap varying in size within a relatively broad range.

In the achievement of the foregoing objects, a feature of the invention relates to an auger which performs the dual functions of sorting product from scrap and conveying the scrap to a discharge zone where it may either be immediately granulated or collected to be processed later in a batch. For this purpose, the auger, according to a related feature, is formed with multiple flights to provide narrow pitch spacing at a receiving zone and with a single flight to provide wider pitch spacing in a transport zone. The spacing in the receiving zone is designed so that product dropped on the auger will fall between the flights and through an opening in a trough embracing the auger, on its way to storage. On the other hand, assemblies of sprues and runners free of product is of such a broad extent that it does not pass between the flights in the receiving zone but is carried by the action of the auger to a discharge point where it is directed to further processing.

According to a related feature, the auger is provided with closely fitting covers which in effect direct the scrap to the bottom of the trough to be carried to the discharge point once the scrap has progressed outside the receiving zone.

The foregoing objects and features will be more clearly understood from the following detailed description of an illustrative embodiment of the invention taken in connection with the accompanying drawings in which.

Figure 1:
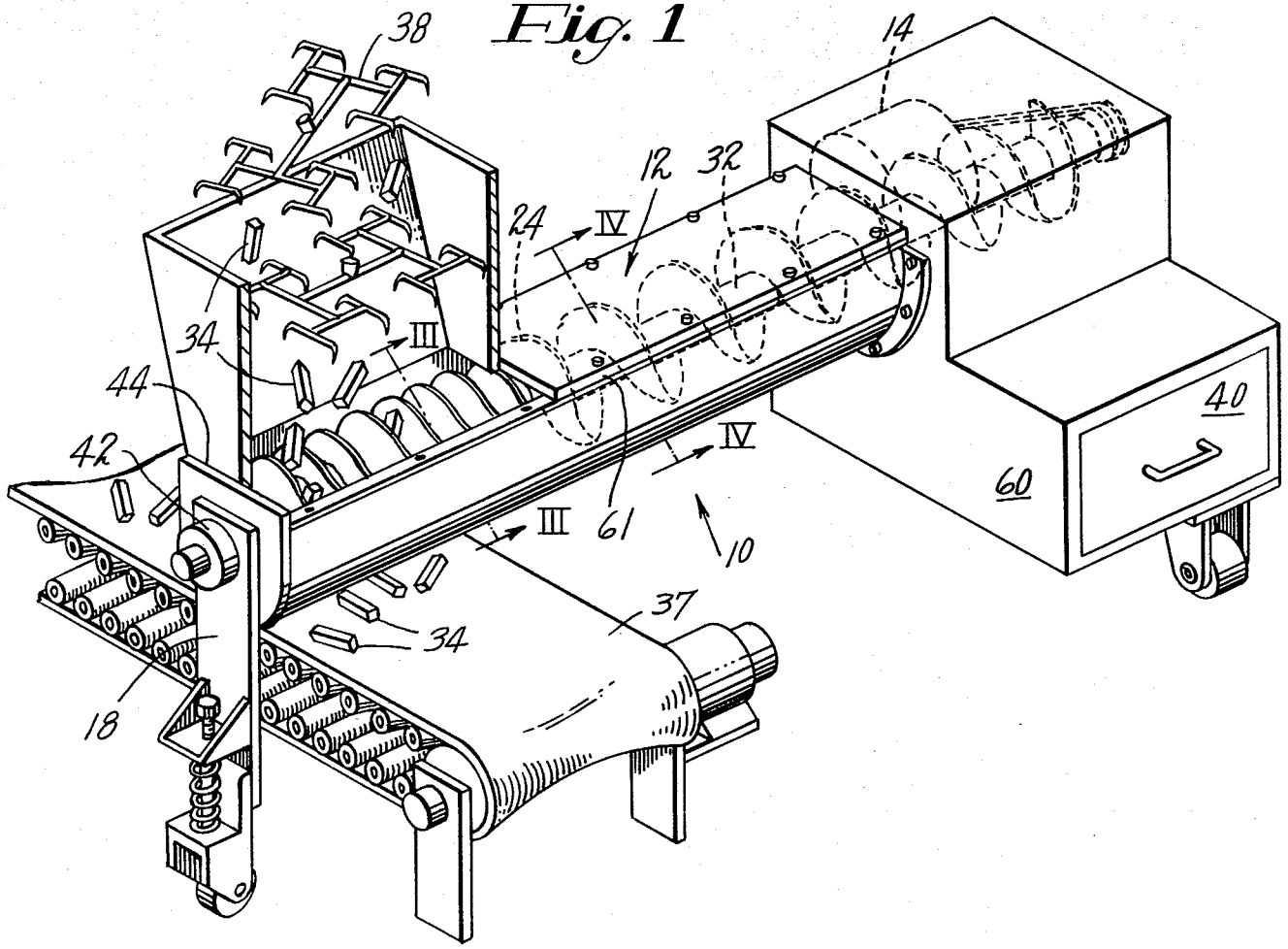
FIG. 1 is a view in perspective as seen from the left front of a machine according to the present invention, for sorting product from scrap and directing both product and scrap to areas where each may be separately collected.
Figure 6:
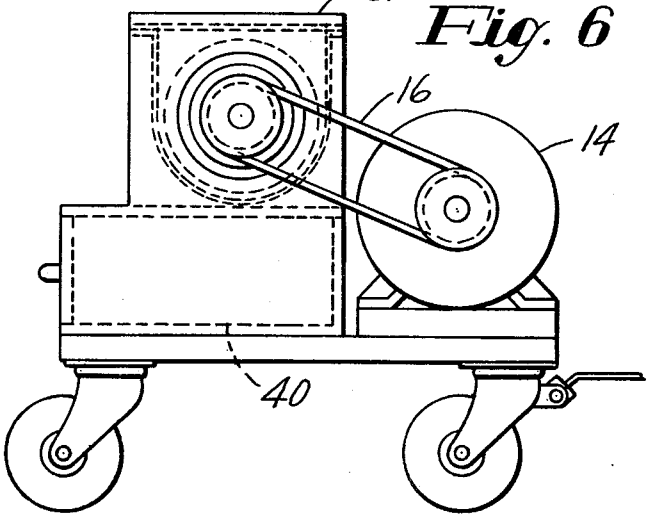
FIG. 6 is a view in end elevation showing drive elements of the machine depicted in the other views.

Turning now to the drawings, particularly FIG. 1, there is shown a sorting machine indicated generally at 10 and including an auger indicated generally at 12 which is driven by a combined electric motor and gear reducer 14 through a Vee belt 16 as seen in FIG. 6. The auger 12 is journalled in a composite frame including an adjustable leg 18 and a trough 20 which closely embraces the auger, as will be seen.

Figure 2:
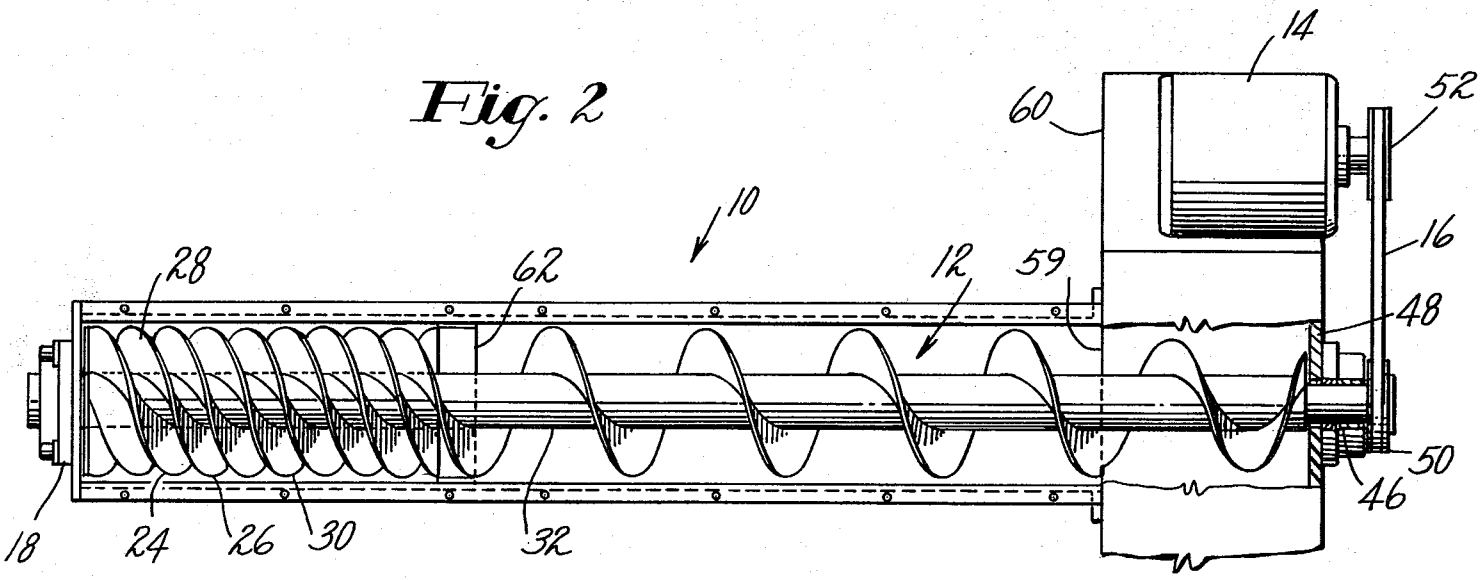
FIG. 2 is a plan view of the machine of FIG. 1 shown with covers removed from the transport zone for clarity.

As seen in FIGS. 1 and 2, the auger 12 includes a main helical flight 24 extending the full length of the trough, from the receiving zone to the left through the transport zone to the scrap discharge area. In the receiving zone, there are three additional short inserted flights, which have the effect of reducing the pitch of the auger in the receiving zone to one quarter that in the transport zone. The inserted flights, which are all of the same lead as the main flight, are designated as the first, second and third inserted flights 26, 28 and 30 respectively and together with the main flight are fixedly mounted at equal angular intervals on a shaft 32. At the left or input end, the spacing of the flights is such that parts 34 pass between the flights and through a discharge opening 36 in the trough 20 and onto a conveyor belt 37, whereas sprue and runner assemblies 38 are too broad in extent to pass between the flights and are accordingly carried on top of the auger 12 to the right toward the discharge. As shown in FIGS. 1 and 6, the discharge is into a drawer 40 but could be directly onto a conveyor belt to be carried to a central granulating machine or to a smaller granulator positioned adjacent the sorter. The shaft 32 is rotatably mounted in bearings at its ends, one designated at 42 supported on the leg 18 and a closing plate 44 for the trough 20 and a similar bearing 46 seen in FIG. 2 and supported on a plate 48 forming a part of the frame at the right end. Outside the bearing 46, there is mounted on the shaft 32, a driven pulley 50 coupled to a driving pulley 52 by the belt 16.

Figure 3:
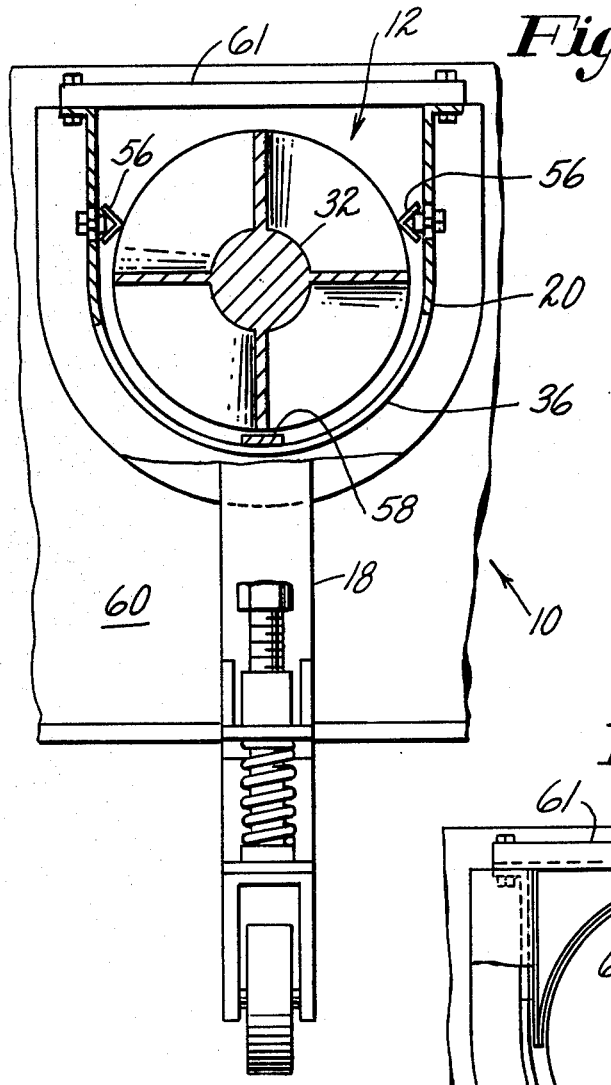
FIG. 3 is a view in cross-section of the receiving zone of the machine of FIGS. 1 and 2 taken along the line III—III of FIG. 1.
Figure 4:
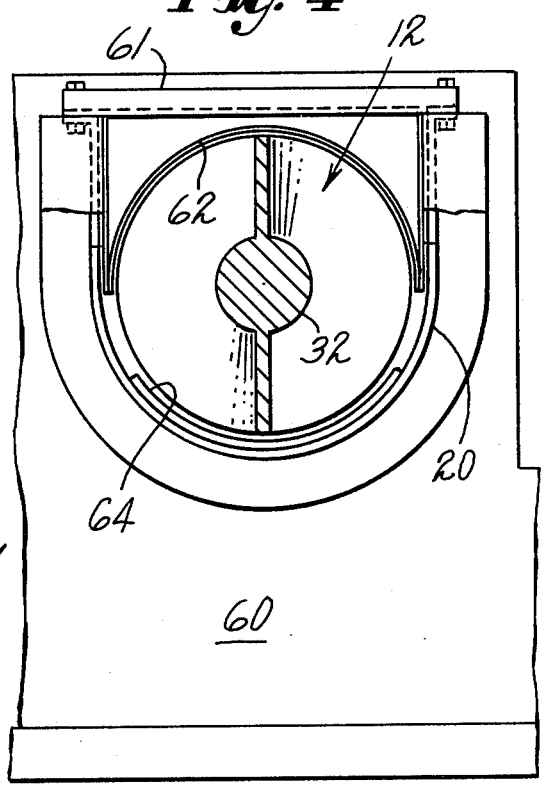
FIG. 4 is a view in cross-section showing the relationship of an augur and trough forming a part of the machine taken along the line IV—IV of FIG. 1.
Figure 5:
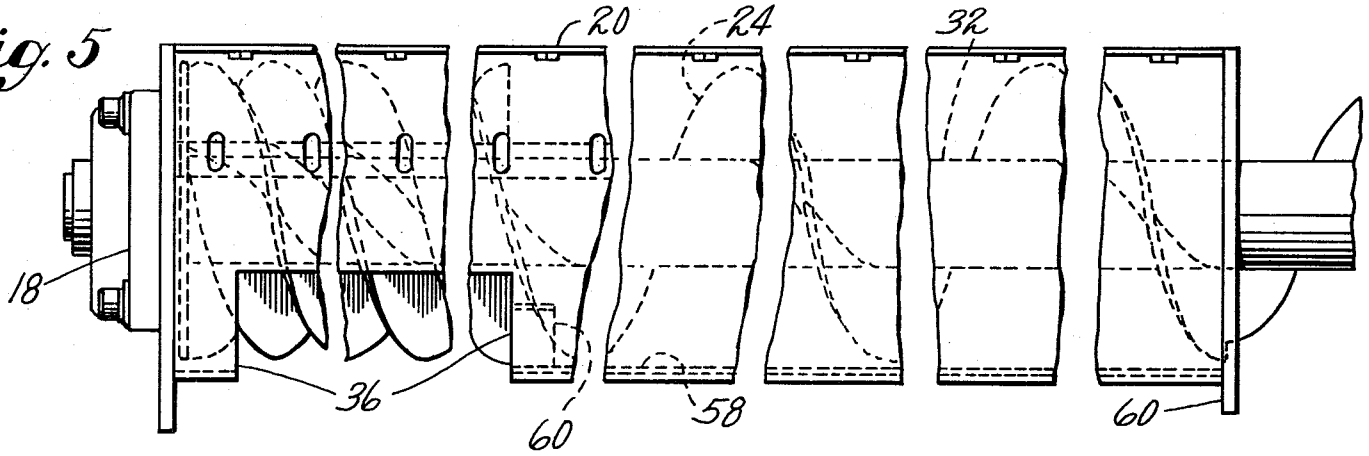
FIG. 5 is a fragmentary view in front elevation of the machine of the previous Figures.

As seen particularly in FIGS. 3 to 5 inclusive, the trough 20 is fitted with a number of control members for guiding the travel of parts 34 and sprue and runner assemblies 38. In order to prevent the sprue and runner assemblies, which, in some cases, are relatively thin, barrier bars 56 are fixedly mounted on the interior of the trough 20, as seen in FIG. 3. The bars 56 extend at least the length of the inserted flights 26, 28 and 30 and are adjustable on the interior of the trough so as to be lowered close to the auger 12 to provide minimum spacing between the auger and the bars, thereby to prevent the jamming of sprue and runner assemblies between the auger and the interior of the trough.

In order to assist the auger in advancing scrap toward the discharge end at the drawer 40, there is affixed to the bottom of the interior of the trough 20, a longitudinal bar 58, extending from the discharge opening 36 to the right end of the trough 20. The bar 58 is spaced a very narrow distance away from the auger 12 so that sprue and runner assemblies 38 are prevented from being carried around by the auger without advancing toward the discharge end. Instead, the assemblies 38 drop to the bottom of the trough and in contact with one side of the bar 58 to receive a sliding motion toward the discharge drawer 40, passing through an opening 59 in a housing wall 60 to which the discharge end of the trough 20 is secured. A cover 61 is fixedly supported, being attached by bolts to a flange at the upper edge of the trough. For directing scrap to the bottom of the trough, the cover 61 extends from approximately the end of the auxilliary flights and is formed to embrace closely the upper portion of the auger 12.

The trough 12 is additionally fitted with an arcuate dam 64 at the right end of the parts discharge opening 36. The dam 64, which is also narrowly spaced from the auger 12, prevents assemblies 38 from backing up and being discharged along with acceptable parts through the opening 36.

From the foregoing description of an illustrative embodiment, taken with the accompanying drawings, many variations within the spirit of the present invention will immediately become apparent to those of ordinary skill in the art. It is therefore not intended that the foregoing be taken by way of limitation, but rather that the scope of the invention be interpreted in accordance with the appended claims.

Having thus disclosed my invention, what I claim as new and desire to secure by Letters Patent of the United States is:

1. A sorter for separating acceptable parts from scrap and conveying parts and scrap in different directions to separate discharge areas, comprising a shaft, an auger assembly including a main flight fixed upon the shaft and extending the length of the auger, a trough having a semi-circular bottom disposed in generally concentric relationship with the auger and formed with an opening defining a parts discharge area, at least one auxilliary flight fixed to the shaft and extending along the auger a distance less than the length of the main flight and at least equal to the length of the discharge opening, a dam in the bottom of the trough at the edge of the discharge opening in the direction of scrap travel and means for imparting a rotary motion to the shaft.

2. A sorter for separating acceptable parts from scrap and conveying parts and scrap in different directions to separate discharge areas, comprising a single shaft, a single auger assembly including a main flight fixed upon the shaft and extending the length of the auger, a trough having a semi-circular bottom disposed in generally concentric relationship with the auger and formed with an opening defining a parts discharge area, at least one auxilliary flight fixed to the shaft and extending along the auger a distance less than the length of the main flight and at least the length of the discharge opening, a longitudinally oriented bar in the bottom of the trough, parallel and narrowly spaced from the auger between the parts discharge opening and the scrap discharge area, and means for imparting a rotary motion to the shaft.

3. A sorter for separating acceptable parts from scrap and conveying parts and scrap in different directions to separate discharge areas, comprising a shaft, an auger assembly including a main flight fixed upon the shaft and extending the length of the auger, a trough having a semi-circular bottom disposed in generally concentric relationship with the auger and formed with an opening defining a parts discharge area, at least one auxilliary flight fixed to the shaft and extending along the auger a distance less than the length of the main flight and at least equal to the length of the discharge opening, a pair of barrier bars fixedly mounted on the interior wall of the trough in close proximity to the auger and extending at least the length of the discharge opening, a dam at the bottom of the trough at the edge of the discharge opening in the direction of scrap travel and means for imparting a rotary motion to the shaft.

4. A sorter according to claim 3 further comprising a longitudinally oriented bar in the bottom of the trough, both the dam and the longitudinal bar being narrowly spaced from the auger between the parts discharge opening and the scrap discharge area.

* * * * *